US009951744B2

(12) United States Patent
Hwang et al.

(10) Patent No.: US 9,951,744 B2
(45) Date of Patent: Apr. 24, 2018

(54) OPTIMIZED MULTIPLE LASER IGNITION PLUG

(71) Applicants: DENSO International America, Inc., Southfield, MI (US); DENSO CORPORATION, Kariya, Aichi-pref. (JP)

(72) Inventors: Jeongung Hwang, Northville, MI (US); Nicholas C. Polcyn, Commerce, MI (US); Jeremy Koscielny, Brighton, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 72 days.

(21) Appl. No.: 15/165,413

(22) Filed: May 26, 2016

(65) Prior Publication Data

US 2017/0342956 A1 Nov. 30, 2017

(51) Int. Cl.
*F02P 23/04* (2006.01)

(52) U.S. Cl.
CPC ..... *F02P 23/045* (2013.01); *F02P 23/04* (2013.01)

(58) Field of Classification Search
CPC ..... F02P 23/04
USPC ..... 123/143 B, 305
See application file for complete search history.

(56) References Cited

U.S. PATENT DOCUMENTS

| | | | | |
|---|---|---|---|---|
| 7,231,897 | B2 * | 6/2007 | Herdin | F02B 1/12 123/143 A |
| 8,701,613 | B2 | 4/2014 | Herden et al. | |
| 8,833,323 | B2 | 9/2014 | Weyl et al. | |
| 2004/0168662 | A1 * | 9/2004 | Wintner | F02P 23/04 123/143 B |
| 2006/0032470 | A1 * | 2/2006 | Ridderbusch | F02P 23/04 123/143 B |
| 2008/0257294 | A1 * | 10/2008 | Vogel | F02B 23/105 123/143 B |
| 2008/0264371 | A1 * | 10/2008 | Taido | F02P 15/00 123/143 B |
| 2009/0158952 | A1 * | 6/2009 | Gruber | F02P 23/04 102/201 |
| 2009/0178643 | A1 * | 7/2009 | Rogler | F02B 5/02 123/305 |
| 2012/0145107 | A1 * | 6/2012 | Schwarz | F02P 15/08 123/143 B |
| 2013/0000597 | A1 | 1/2013 | Weinrotter et al. | |
| 2013/0186362 | A1 | 7/2013 | Kanehara et al. | |

* cited by examiner

*Primary Examiner* — Erick Solis
(74) *Attorney, Agent, or Firm* — Harness, Dickey & Pierce, P.L.C.

(57) ABSTRACT

An ignition device for an internal combustion engine includes optical focusing lenses, including a center optical focusing lens and satellite optical focusing lens. The center optical focusing lens focuses laser light from a laser generator to a center ignition point in a combustion chamber of a cylinder of the internal combustion engine. The satellite optical focusing lenses focus laser light from the laser generator to satellite ignition points in the combustion chamber of the cylinder of the internal combustion engine. The satellite optical focusing lenses are directionally angled away from the center optical focusing lens. A firing depth of the center ignition point is greater than a firing depth of the at least one satellite ignition point.

17 Claims, 2 Drawing Sheets

OPTIMIZED MULTIPLE LASER IGNITION PLUG

FIELD

The present disclosure relates to a laser ignition plug with multiple ignition points for an internal combustion engine.

BACKGROUND

This section provides background information related to the present disclosure which is not necessarily prior art.

Internal combustion engines typically include a combustion chamber, intake and exhaust ports, a compression device, a fuel delivery system, and an ignition device. A combustible mixture of air and fuel flows into the combustion chamber through the intake port and is ignited by the ignition device. The ignition device may be a laser ignition plug that emits focused laser light into the combustion chamber to produce flame kernel and ignite the mixture of air and fuel. Conventional laser ignition plugs, however, emit a single laser pulse to ignite the mixture of air and fuel and are subject to improvement.

SUMMARY

This section provides a general summary of the disclosure and is not a comprehensive disclosure of its full scope or all of its features.

The present teachings are directed to an ignition device for an internal combustion engine. The ignition device includes a plurality of optical focusing lenses, including a center optical focusing lens and at least one satellite optical focusing lens. The center optical focusing lens is configured to focus laser light from a laser generator to a center ignition point in a combustion chamber of a cylinder of the internal combustion engine. The at least one satellite optical focusing lens is configured to focus laser light from the laser generator to at least one satellite ignition point in the combustion chamber of the cylinder of the internal combustion engine. The at least one satellite optical focusing lens is directionally angled away from the center optical focusing lens. A firing depth of the center ignition point is greater than a firing depth of the at least one satellite ignition point.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The present teachings are directed toward a laser ignition plug that uses focused laser light to ignite a combustible air-fuel mixture within a combustion chamber of an internal combustion engine. As discussed in further detail below, the laser ignition plug uses multiple lasers to generate multiple ignition points at different firing projections and depths, resulting in enhanced ignitability. In internal combustion engines using highly diluted and lean burn combustion mixtures, ignitable pockets of the air-fuel mixture may be less prevalent than in traditional internal combustion engines that do not use highly diluted and lean burn combustion mixtures. As such, using a laser ignition plug with multiple lasers that generate multiple ignition points at different firing projections and depths can increase the combustion stability and performance, as well as the efficiency of the internal combustion engine.

Figure 1A:
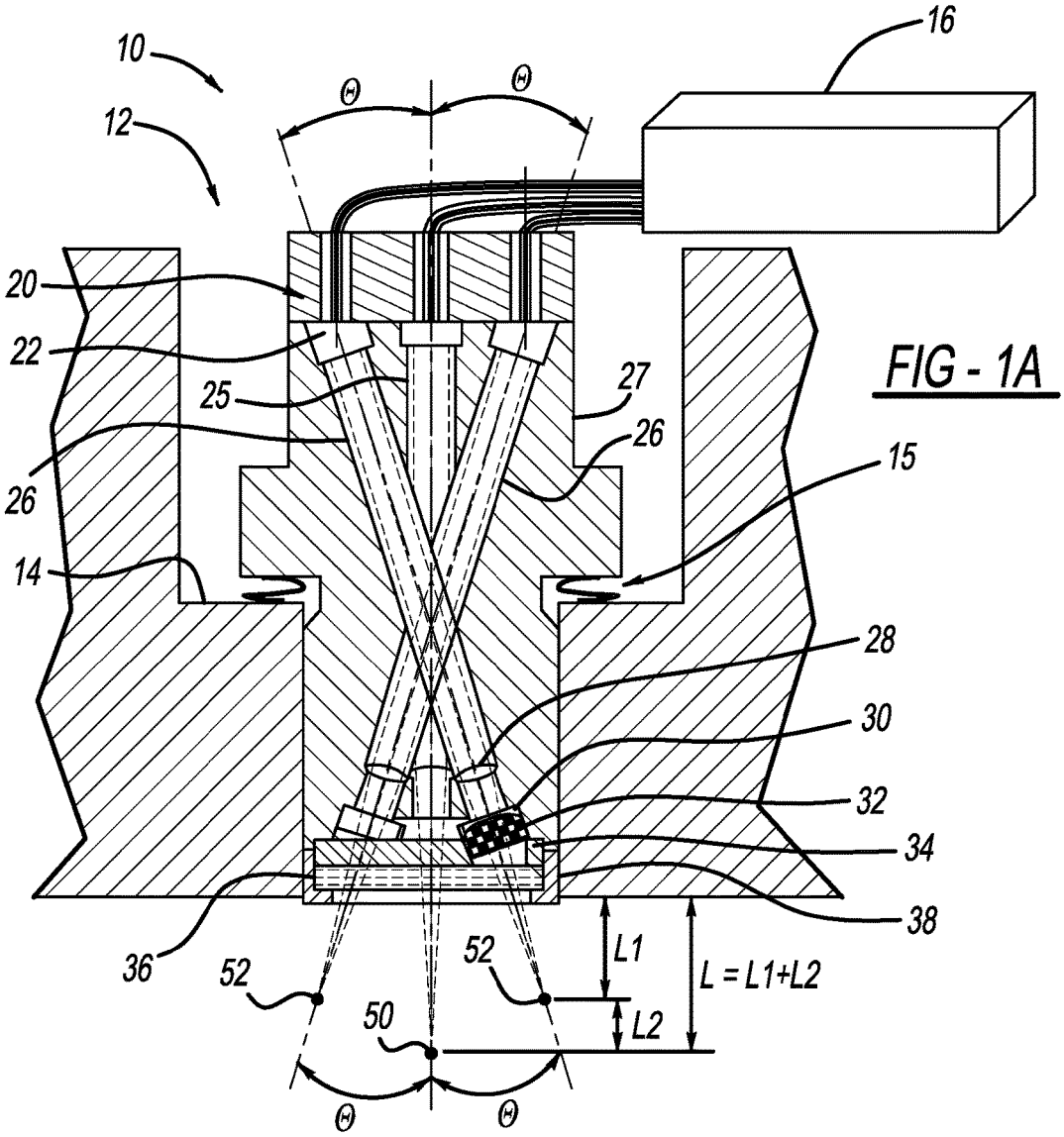
FIG. 1A is a sectional view of a portion of an internal combustion engine including a laser ignition plug according to the present teachings.

With reference to FIG. 1A, a sectional view of a portion of an internal combustion engine 10 is illustrated and includes a laser ignition plug 12 installed in a plug bore of a cylinder head 14 of the internal combustion engine 10. A gasket 15 is installed around the plug bore of the cylinder head 14 to form a seal between the laser ignition plug 12 and the cylinder head 14. The plug bore of the cylinder head 14 is aligned with a combustion chamber formed by a cylinder and a piston positioned within a bore of the cylinder. The laser ignition plug 12 ignites a combustible mixture of air and fuel that flows into the combustion chamber through an intake port. The resulting combustion drives the piston in the cylinder and a connected connecting rod, to turn, for example, a crankshaft of the internal combustion engine 10.

The laser ignition plug 12 is connected to a laser generator 16. The laser generator 16 can be a pulse laser generator configured to selectively emit pulses of laser light. The laser generator 16 emits laser light through optical fiber connections 18 to the laser ignition plug 12. While the sectional view of FIG. 1A illustrates three optical fiber connections 18, additional optical fiber connections 18, which are not shown in FIG. 1A, are used to connect the laser generator 16 to the laser ignition plug 12. For example, as discussed in further detail below, the laser ignition plug 12 utilizes five lasers to generate five ignition points within the combustion chamber. As such, the laser ignition plug 12 utilizes five optical fiber connections 18, three of which are shown in the sectional view of FIG. 1A, to receive light from the laser generator 16. Additional or fewer optical fiber connections 18 can also be used.

Figure 3:
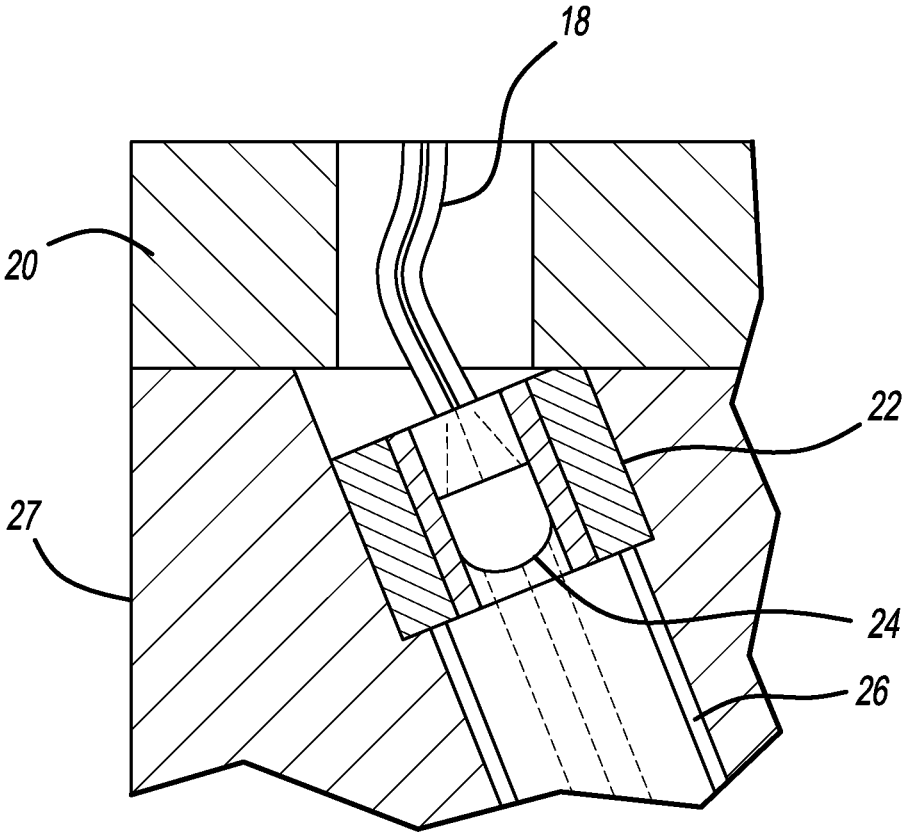
FIG. 3 is a close-up sectional view of a portion of the laser ignition plug of FIG. 1.

The optical fiber connections 18 are received by a cover plate 20 of the laser ignition plug 12 and fed through the cover plate 20 to connect to collimating lens housings 22. The collimating lens housings 22 are each connected to optical lens support tubes 25, 26 positioned within a laser ignition plug housing 27 of the laser ignition plug 12. As discussed in further detail below, the optical lens support tubes 25, 26 include a center optical lens support tube 25 and multiple satellite optical lens support tubes 26. With reference to FIG. 3, a close up sectional view of one of the collimating lens housings 22 is shown. The collimating lens housing 22 houses a collimating lens 24. As shown in FIG. 3, the optical fiber connection 18 emits divergent light onto the collimating lens 24. The collimating lens 24 collimates the divergent light received from the optical fiber connection 18 and emits collimated light into the optical lens support tube 26. The close up section view of FIG. 3 shows a collimating lens housing 22 and collimating lens 24 for one of the satellite optical lens support tubes 26. The center optical lens support tube 25 includes a similar collimating lens 24 and collimating lens housing 22.

With reference again to FIG. 1A, the collimated light emitted from collimating lenses 24 and collimating lens housings 22 travels through the optical lens support tubes 25, 26 and is received by optical lenses 28. The optical lenses 28 converge the received light toward corresponding optical focusing lenses 32 housed in optical focusing lens housings 30. The optical focusing lenses 32 emit the received light through an optical focusing lens plate 34. A protecting lens 36 covers and protects the optical focusing lenses 32 and separates the interior of the laser ignition plug 12 from the combustion chamber of the internal combustion engine 10. A protecting lens plate 38 holds the protecting lens 36 in place at the end of the laser ignition plug 12.

Figure 1B:
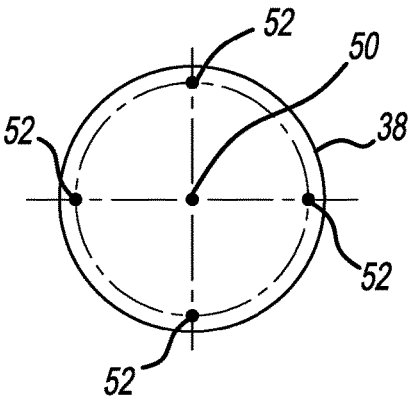
FIG. 1B is a top view of multiple ignition points produced by the laser ignition plug of FIG. 1.

As shown in FIG. 1A, the optical focusing lenses 32 converge and focus the laser light into corresponding ignition points, which have different firing projections and firing depths. A top view of the multiple ignition points is shown in FIG. 1B. With reference to FIGS. 1A and 1B, the multiple ignition points include a center ignition point 50 and multiple satellite ignition points 52. In the example of FIGS. 1A and 1B, one center ignition point 50 and four satellite ignition points 52 are shown. As shown in FIG. 1B, the satellite ignition points 52 are located at ninety degree intervals around the center ignition point 50.

As shown in FIG. 1A, the multiple ignition points 50, 52 have different firing depths relative to the cylinder head 14. For example, the optical focusing lens 32 of the center optical lens support tube 25 is configured to focus laser light at the center ignition point 50 located at a firing depth of L relative to the cylinder head 14. The optical focusing lenses 32 of the satellite optical lens support tubes 26 are configured to focus laser light at respective satellite ignition points 52 located at a firing depth of L1 relative to the cylinder head 14. The firing depth L of the center ignition point 50 may be greater than the firing depth L1 of the satellite ignition points 52, such that the difference between the firing depth L and the firing depth L1 equals L2, as shown in FIG. 1A. In other words, the firing depths L and L1 may be chosen as shown in equation (1) such that:

$$L=L1+L2, \text{ where } L1 \text{ is not equal to } L2. \quad (1)$$

Further, the firing depth L1 of the satellite ignition points 52 may be more than half of the firing depth L of the center ignition point 50.

As shown in FIG. 1A, the center optical lens support tube 25 is vertically aligned within the laser ignition plug housing 27 such that a vertical axis of the center optical lens support tube 25 is generally parallel to the outer walls of the laser ignition plug housing 27 and generally perpendicular to a horizontal axis of a plane of the protecting lens 36, the optical focusing lens plate 34, and/or the cover plate 20. In addition, each of the satellite optical lens support tubes 26 are configured within the laser ignition plug housing 27 to be vertically offset from the center optical lens support tube 25 by an offset angle theta (θ), as viewed in cross-section from a side of the laser ignition plug 12 and shown in FIG. 1A. As shown in FIG. 1A, the lasers emitted by the satellite optical lens support tubes 26 are likewise vertically offset by the offset angle theta (θ) from the laser emitted by the center optical lens support tube 25, as viewed in cross-section from a side of the laser ignition plug 12 and shown in FIG. 1A. Further, the satellite optical lens support tubes 26 are angled by the offset angle theta (θ) such that the optical focusing lenses 32 are directionally pointed away from the center optical lens support tube 25 and towards a periphery of the laser ignition plug housing 27. The offset angle theta (θ) could be in a range of ten to thirty degrees. Alternatively, other offset angles that are either less than ten degrees or greater than thirty degrees could also be used.

Because the satellite optical lens support tubes 26 are angled by the offset angle theta (θ) and the optical focusing lenses 32 are pointed towards the periphery of the laser ignition plug housing 27, the resulting satellite ignition points 52 can be located further away from the laser emitted by the center optical lens support tube 25, as compared with a configuration of satellite optical lens support tubes that are not angled and that are configured to be parallel with a vertical axis of the center optical lens support tube 25. With reference again to FIG. 1B, the top view of the multiple ignition points illustrates, for example, that the satellite ignition points 52 are horizontally located in close proximity to a cylinder formed by extending an edge of the protecting lens plate 38 and/or a cylinder formed by extending an edge of the laser ignition plug housing 27. For example, the satellite ignition points 52 can be horizontally located a distance from a cylinder formed by extending an edge of the protecting lens plate 38 that is less than half of the radius of the satellite optical lens support tubes 26. While FIG. 1B illustrates the satellite ignition points 52 as being horizontally located within the cylinder formed by extending the edge of the protecting lens plate 38, the satellite ignition points 52 could alternatively be horizontally located at or beyond the cylinder formed by extending the edge of the protecting lens plate 38 when viewed from a top or bottom view.

Figure 2:
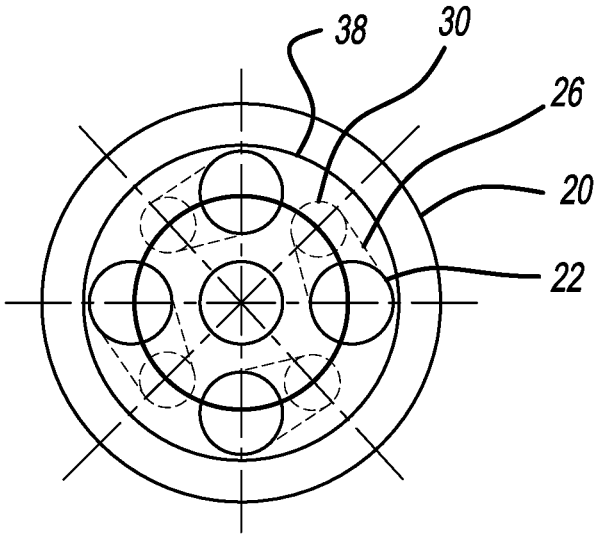
FIG. 2 is a top view of a portion of the laser ignition plug of FIG. 1.

With reference to FIG. 2, a three-dimensional top view of a portion of the laser ignition plug 12 is shown. For example, FIG. 2 illustrates an outer periphery of the cover plate 20 along with the collimating lens housings 22 for the center and satellite optical lens support tubes 25, 26. In addition, the satellite optical lens support tubes 26 and the optical focusing lens housings 30 for the satellite optical lens support tubes 26 are shown in dashed lines in FIG. 2. As illustrated in FIG. 2, when viewed from the top view, the satellite optical lens support tubes 26 are angled in a counter-clockwise direction around the center satellite optical lens support tube 26. For example, the satellite optical lens support tubes 26 can be angled such that an angle formed by a line from (a) the center of the collimating lens housing 22 for a satellite optical lens support tube 26 to (b) the center of the collimating lens housing 22 for the center optical lens support tube 26 is forty-five degrees offset from a line from (c) the center of the optical focusing lens housing 30 for a satellite optical lens support tube 26 to (d) the center of the collimating lens housing 22 for the center optical lens support tube 26 when viewed from the top view, as shown in FIG. 2. While such an angle is shown as forty-five degrees in FIG. 2, other angles could alternatively be used. Further, while the satellite optical lens support tubes 26 illustrated in FIG. 2 are angled in a counter-clockwise direction around the center satellite optical lens support tube 26, the satellite optical lens support tubes 26 could alternatively be angled in a clockwise direction around the center satellite optical lens support tube 26.

In this way, as shown in FIG. 2, the axes of the satellite optical lens support tubes 26 are each non-parallel with an axis of the center optical lens support tube 26. Further, the axes of the axes of the satellite optical lens support tubes 26 each form skew lines with the axis of the center optical lens support tube 26. Further, the satellite optical lens support tubes 26 are configured such that the corresponding optical focusing lenses 32 for each satellite optical lens support tube 26 is pointed in a direction away from the center of the optical focusing lens 32 for the center optical lens support tube 26.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. An ignition device for an internal combustion engine, the ignition device comprising:

a plurality of optical focusing lenses, including a center optical focusing lens and at least one satellite optical focusing lens, the center optical focusing lens configured to focus laser light from a laser generator to a center ignition point in a combustion chamber of a cylinder of the internal combustion engine and the at least one satellite optical focusing lens configured to focus laser light from the laser generator to at least one satellite ignition point in the combustion chamber of the cylinder of the internal combustion engine;

a center optical lens support tube configured to receive laser light from the laser generator and emit laser light to the center optical focusing lens; and at least one satellite optical lens support tube configured to receive laser light from the laser generator and emit laser light to the at least one satellite optical focusing lens;

wherein the at least one satellite optical focusing lens is directionally angled away from the center optical focusing lens and wherein a firing depth of the center ignition point is greater than a firing depth of the at least one satellite ignition point; and wherein the at least one satellite optical lens support tube is not parallel with the center optical lens support tube.

2. The ignition device of claim 1, wherein the at least one satellite optical focusing lens includes four satellite optical focusing lenses arranged around the center optical focusing lens.

3. The ignition device of claim 1, wherein a first axis of the center optical lens support tube and at least one second axis of the at least one satellite optical lens support tube are skew lines with respect to each other.

4. The ignition device of claim 1, wherein the ignition device has a first end that is proximate to the combustion chamber of the cylinder when installed in the internal combustion engine and a second end that is opposite to the first end, and wherein the at least one satellite optical lens support tube is angled in a counter-clockwise direction around the center optical lens support tube relative to the first end of the ignition device.

5. The ignition device of claim 1, wherein the ignition device has a first end that is proximate to the combustion chamber of the cylinder when installed in the internal combustion engine and a second end that is opposite to the first end, and wherein the at least one satellite optical lens support tube is angled in a clockwise direction around the center optical lens support tube relative to the first end of the ignition device.

6. The ignition device of claim 1, further comprising:

a center collimating lens in a center collimating lens housing that receives divergent laser light from a first optical fiber connection connected to the laser generator and that collimates the divergent laser light into collimated laser light and emits the collimated laser light into the center optical lens support tube; and at least one satellite collimating lens in at least one satellite collimating lens housing that receives divergent laser light from at least one second optical fiber connection connected to the laser generator and that collimates the divergent laser light into collimated laser light and emits the collimated laser light into the at least one satellite optical lens support tube.

7. The ignition device of claim 6, further comprising:

a center optical lens located within the center optical lens support tube that receives the collimated laser light from the center collimating lens and that emits converged laser light to the center optical focusing lens; and at least one satellite optical lens located within the at least one satellite optical lens support tube that receives the collimated laser light from the at least one satellite collimating lens and that emits converged laser light to the at least one satellite optical focusing lens.

8. The ignition device of claim 1, wherein the firing depth of the center ignition point and the firing depth of the at least one satellite ignition point are configured such that $L=L1+L2$, where L corresponds to the firing depth of the center ignition point, L1 corresponds to the firing depth of the at least one satellite ignition point, L2 corresponds to the difference between the firing depth of the center ignition point and the firing depth of the at least one satellite ignition point, and L1 is not equal to L2.

9. A method comprising:

focusing, with a center optical focusing lens of an ignition device, laser light from a laser generator to a center ignition point in a combustion chamber of a cylinder of an internal combustion engine;

focusing, with at least one satellite optical focusing lens of the ignition device, laser light from the laser generator to at least one satellite ignition point in the combustion chamber of the cylinder of the internal combustion engine;

receiving, with a center optical lens support tube, laser light from the laser generator;

emitting, with the center optical lens support tube, laser light to the center optical focusing lens;

receiving, with at least one satellite optical lens support tube, laser light from the laser generator; and emitting, with the at least one satellite optical lens support tube, laser light to the at least one satellite optical focusing lens;

wherein the at least one satellite optical focusing lens is directionally angled away from the center optical focusing lens and wherein a firing depth of the center ignition point is greater than a firing depth of the at least one satellite ignition point; and wherein the at least one satellite optical lens support tube is not parallel with the center optical lens support tube.

10. The method of claim 9, wherein the at least one satellite optical focusing lens includes four satellite optical focusing lenses arranged around the center optical focusing lens.

11. The method of claim 9, wherein a first axis of the center optical lens support tube and at least one second axis of the at least one satellite optical lens support tube are skew lines with respect to each other.

12. The method of claim 9, wherein the ignition device has a first end that is proximate to the combustion chamber of the cylinder when installed in the internal combustion engine and a second end that is opposite to the first end, and wherein the at least one satellite optical lens support tube is angled in a counter-clockwise direction around the center optical lens support tube relative to the first end of the ignition device.

13. The method of claim 9, wherein the ignition device has a first end that is proximate to the combustion chamber of the cylinder when installed in the internal combustion engine and a second end that is opposite to the first end, and wherein the at least one satellite optical lens support tube is angled in a clockwise direction around the center optical lens support tube relative to the first end of the ignition device.

14. The method of claim 9, further comprising:

receiving, with a center collimating lens in a center collimating lens housing, divergent laser light from a first optical fiber connection connected to the laser generator;

collimating, with the center collimating lens, the divergent laser light into collimated laser light;

emitting, with the center collimating lens, the collimated laser light into the center optical lens support tube; and receiving, with at least one satellite collimating lens in at least one satellite collimating lens housing, divergent laser light from at least one second optical fiber connection connected to the laser generator;

collimating, with the at least one satellite collimating lens, the divergent laser light into collimated laser light; and emitting, with the at least one satellite collimating lens, the collimated laser light into the at least one satellite optical lens support tube.

15. The method of claim 14, further comprising:

receiving, with a center optical lens located within the center optical lens support tube, the collimated laser light from the center collimating lens;

emitting, with the center optical lens, converged laser light to the center optical focusing lens;

receiving, with at least one satellite optical lens located within the at least one satellite optical lens support tube, the collimated laser light from the at least one satellite collimating lens; and emitting, with the at least one satellite optical lens, converged laser light to the at least one satellite optical focusing lens.

16. The method of claim 9, wherein the firing depth of the center ignition point and the firing depth of the at least one satellite ignition point are configured such that $L=L1+L2$, where L corresponds to the firing depth of the center ignition point, L1 corresponds to the firing depth of the at least one satellite ignition point, L2 corresponds to the difference between the firing depth of the center ignition point and the firing depth of the at least one satellite ignition point, and L1 is not equal to L2.

17. A system comprising:

an internal combustion engine having a combustion chamber formed by a cylinder, a piston positioned within a bore of the cylinder, and a cylinder head;

a laser generator that generates laser light;

an ignition device installed in a plug bore of the cylinder head, the ignition device receiving laser light from the laser generator through optical fiber connections, the ignition device having a plurality of optical focusing lenses, including a center optical focusing lens and a plurality of satellite optical focusing lenses, the center optical focusing lens configured to focus laser light from a laser generator to a center ignition point in the combustion chamber and the plurality of satellite optical focusing lenses configured to focus laser light from the laser generator to a plurality of satellite ignition points in the combustion chamber;

a center optical lens support tube configured to receive laser light from the laser generator and emit laser light to the center optical focusing lens; and at least one satellite optical lens support tube configured to receive laser light from the laser generator and emit laser light to the at least one satellite optical focusing lens;

wherein the plurality of satellite optical focusing lenses are directionally angled away from the center optical focusing lens and wherein a firing depth of the center ignition point is greater than a firing depth of the plurality of satellite ignition points; and wherein the at least one satellite optical lens support tube is not parallel with the center optical lens support tube.

* * * * *